US009561154B1

(12) United States Patent
Kostelac

(10) Patent No.: US 9,561,154 B1
(45) Date of Patent: Feb. 7, 2017

(54) PILLBOX LOADING DEVICE

(71) Applicant: Matthew Kostelac, Mechanicsburg, PA (US)

(72) Inventor: Matthew Kostelac, Mechanicsburg, PA (US)

( * ) Notice: Subject to any disclaimer, the term of this patent is extended or adjusted under 35 U.S.C. 154(b) by 0 days.

(21) Appl. No.: 14/993,400

(22) Filed: Jan. 12, 2016

(51) Int. Cl.
*B65B 37/00* (2006.01)
*A61J 1/03* (2006.01)

(52) U.S. Cl.
CPC ..... *A61J 1/03* (2013.01)

(58) Field of Classification Search
CPC ..... A61J 1/03
USPC ..... 141/237, 240, 247
See application file for complete search history.

(56) References Cited

U.S. PATENT DOCUMENTS

| | | | |
|---|---|---|---|
| 6,779,663 | B1 | 8/2004 | Pocsi |
| 8,146,627 | B2 | 4/2012 | Mazur |
| 2009/0206100 | A1 | 8/2009 | Mazur |

*Primary Examiner* — Jason K Niesz
(74) *Attorney, Agent, or Firm* — Hooker & Habib, P.C.

(57) ABSTRACT

A pillbox loading device receives a pillbox and has a top opening alignable with the pillbox compartments. Channels extend from the top opening and define funnels that guide the pills into the pillbox.

20 Claims, 5 Drawing Sheets

PILLBOX LOADING DEVICE

FIELD OF THE DISCLOSURE

The disclosure relates to pillboxes used to store pills or similar solid mendicants or other small objects in individual compartments, and in particular, to devices for loading such pillboxes.

BACKGROUND OF THE DISCLOSURE

Pillboxes are multi-compartment containers having lids or tops that individually open and close the compartments. Pills are placed in the open compartments and the compartments are then closed. When it is time to take a pill, a compartment is opened and the pill is removed for use.

Pillboxes are normally designed to hold pills sufficient for some specific dosage regimen. The pillbox compartments are typically arranged to extend side-by-side along the length of the pillbox, with the number of compartments based on the frequency the pills are to be taken. One common pillbox, for example, has seven transparent compartments labeled to identify each day of the week and are intended to store a week's worth of pills separated by day of the week. Another common pillbox has four transparent compartments labeled to identify different parts of the day—for example, morning, noon, evening, bedtime—and are intended to store a day's worth of pills that are taken at different times of the day.

A user knows whether or not he or she has taken a pill for that day of the week or time of day by simply looking to see whether or not that day's compartment contains pills.

Some pillbox users have physical limitations that makes it difficult for them to place pills into the open compartments of a pillbox. There is a need for a pillbox loading device that allows for easier loading of pillboxes.

SUMMARY OF THE DISCLOSURE

Disclosed is a pillbox loading device that includes a box-like member having spaced apart first and second side walls, spaced apart first and second end walls interconnecting the first and second side walls, the first and second end walls spaced apart from one another in a horizontal direction, and a top closing an upper end of the box-like member, each of the end walls and side walls extending in a vertical direction downwardly away from the top.

The second wall includes a slot extending through the second side wall. The top defines an opening that extends through the top and includes a number of channels and channel walls separating adjacent pairs of channels, the slot being spaced from one or both of the side edges and spaced vertically from an upper end of the first side wall. The channels are side-by-side to one another and extend from the first end wall to the second end wall. Each channel includes a floor extending away from the top opening and sloping upwardly from the top opening towards the top end of the box-like member.

In use, the pillbox is received within the side wall slot to place the open containers of the pillbox in the interior of the box-like member and to align the top opening with the containers. The channels in effect define funnels that direct pills placed on the channel floors towards the opening and to fall into respective compartments of the pillbox.

Because the boxlike member is wider than the pillbox, the widths of the channels away from the top opening is greater than the width of the pillbox compartments, making it easier for a user to place pills on the device and having the device funnel the pills to the pillbox compartments.

In possible embodiments of the disclosed loading device, channel ledges are provided that enable a user to place pills on the channel ledges temporarily before loading the pillbox.

Other objects and features of the disclosure will become apparent as the description proceeds, especially when taken in conjunction with the accompanying drawing sheets illustrating one or more illustrative embodiments.

DETAILED DESCRIPTION

Figure 3:
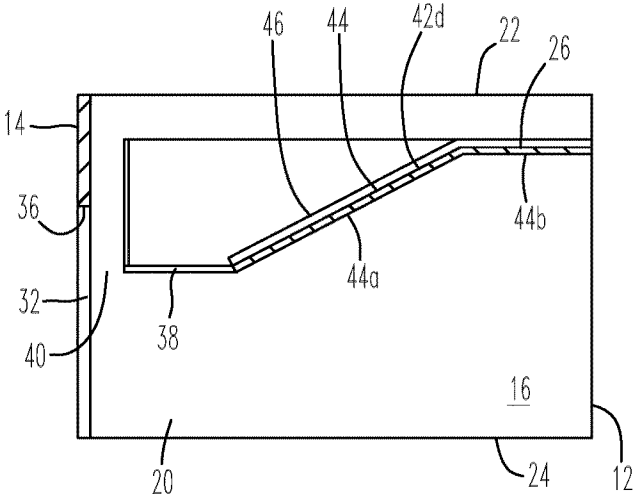
FIG. 3 is a sectional view of the pillbox loading device shown in FIG. 1 taken along line 3-3 of FIG. 2.
Figure 1:
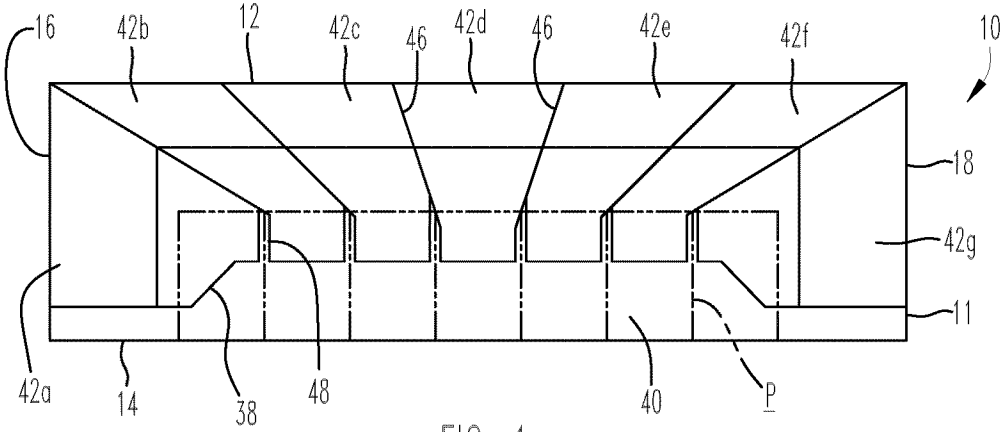
FIGS. 1 and 2 are top and front views respectively of a first embodiment pillbox loading device.
Figure 2:
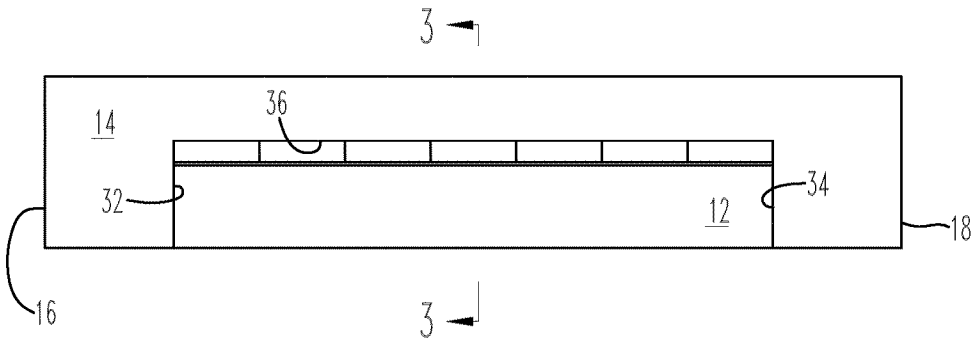

FIGS. 1-3 illustrate a first embodiment pillbox loading device 10. The illustrated pillbox loading device is intended for loading the pillbox compartments of a pillbox P having seven side-by-side storage compartments, the pillbox compartments being shown in phantom lines in FIG. 1.

The pillbox loading device 10 is a unitary one-piece box or box-like member 11 having a pair of spaced-apart first and second side walls 12, 14 respectively and a pair of spaced-apart first and second end walls 16, 18 respectively. The side walls and end walls surround and define a generally prismatic interior 20 of the box 11.

The side walls and end walls define an upper end 22 and an open lower end 24 of the box 11. A top 26 closes the upper portion of the box, with the side walls and end walls extending in a vertical direction downwardly away from the top 26. The side walls and end walls extend to the lower end 24 of the box, the bottom ends of the side walls and end walls being co-planar to allow the bottom of the loading device 10 to be supported evenly on a flat surface.

The second side wall 14 includes a through-opening or slot 30 that is defined by a pair of spaced-apart vertical side walls 32, 34 and a horizontal wall 36 joining the upper ends of the side walls 32, 34 (FIG. 3 exaggerates the thickness of the side wall 14 to more clearly show the slot side wall 32). The slot 30 extends vertically from the horizontal wall 36 to the bottom end of the side wall 12, and is horizontally centered between the end walls 16, 18. The slot 30 is sized to closely receive the compartment body of a pillbox as will be described in greater detail below.

The top 26 is spaced vertically below the upper end of the box 11 and extends from the first end wall 16 to the second end wall 18. The top 26 extends from the first side wall 12 towards the second side wall 14. The top 26 stops short of the second end wall 14 along an edge 38 spaced away from the first side wall 14. The edge 38, the end walls, and the first side wall 12 cooperatively define a mouth or top opening 40 that communicates with the interior 20. The top opening 40 extends along the second side wall 14 from the first end wall 16 to the second end wall 18.

The top 26 includes or defines seven channels 42 (the channels are labeled in FIG. 1 as channels 42*a*, 42*b*, 42*c*, 42*d*, 42*e*, 42*f*, 42*g* respectively), each channel 42 associated with a respective compartment of the pillbox P. The channels 42 are located on an upper surface 44 of the top 26 and are side-by side one another. Elongate channel walls 46 extend along the length of the channels 42 on opposite sides of the channels and also separate adjacent pairs of channels. The top surface 44 forms floors of the respective channels 42*a*-42*g*. The channel walls 46 are proud of the top surface 44.

Through slots 48 are formed between adjacent channels 42 and are sized to receive compartment walls of the pillbox P during use as will be explained in greater detail below. The channel walls 46 bifurcate at the slots 48 and run the length of the slots 48 on both sides of the slots.

Each channel floor 44 extends upwardly away from the opening 40 and extends to an adjacent end wall 16, 18 or the first side wall 12. Channel 42*a* extends to the end wall 16. The channels 42*b*, 42*c*, 42*d*, 42*e*, 42*f* each extends to the first side wall 12. The channel 42*g* extends to the end wall 18.

Each channel floor includes an upwardly sloping floor portion 44*a* that extends away from the opening 40 and a level floor portion or ledge 44*b* that extends to the side or end wall. The lower end of each floor portion 44*a* is intended to be received within a respective compartment of the pillbox P.

As shown in FIG. 1, the width dimension of the side wall 12 extending between the end walls is substantially greater than the total length of the compartments of the pillbox P. The width dimension of each of the end walls 16, 18 extending between the side walls is greater than the width of the compartments of the pillbox P. As each channel floor extends away from the opening 40, the width of the floor increases. Away from the opening 40 the width of each of the floors is substantially greater than the width of each individual pillbox compartment.

Figure 4:
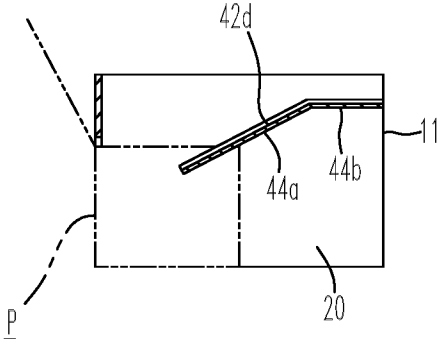
FIG. 4 is similar to FIG. 3 but includes a pillbox in position for loading by the pillbox loading device.

FIG. 4 illustrates use of the pillbox loading device 10 to load the pillbox P resting on a flat surface (not shown) and with the pillbox compartments open. The box 11 is placed over the pillbox P so that the pillbox compartments are received in the box interior 20 through the open bottom end of the box. The pillbox P is received in the wall slot 30 to locate the channels 42 over the pillbox compartments. As the box 11 is placed over the pillbox P, the slots 48 receive the compartment walls that separate the pillbox compartments. Interference of the compartment walls with the sides of the slots 48 assist in limiting relative movement of the pillbox relative to the device 10 during use of the device 10. The lower end of the box 11 is placed against the flat surface with the lower ends of the channels 42 received in and extending into respective compartments of the pillbox P as shown in FIG. 4.

The upper channel ledges 44*b* are level and enable a user to rest pills on the channel ledges 44*b* before loading the pills into the pillbox. Because the width of each of the channel ledges 44*b* are substantially greater than the pillbox compartment width, placing pills on the channel ledges 44*b* is easier than placing the pills directly into the pillbox compartments. Pills resting on the channel ledges 44*b* are simply slid down the channel portions 44*a* to slide the pills down the channels and into the pillbox compartments. The channels 42 form respective funnels that direct the pills to the opening 30 and to then fall through the opening 30 into the pill compartments. The pairs of channel walls 46 lining the channels 42 resist pills in the channels 42 from moving out of their channels and aid in funneling the pills to the pillbox compartments.

After loading the pillbox, the box 11 is lifted away from the pillbox P and the pillbox compartments are then closed.

Figure 5:
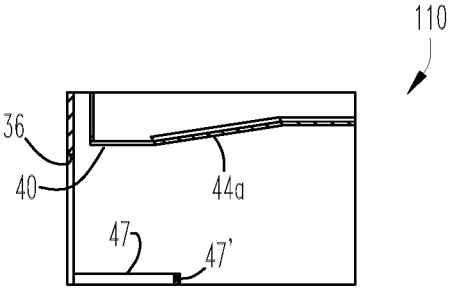
FIG. 5 is a sectional view similar to FIG. 3 of a second embodiment pillbox loading device.

FIG. 5 illustrates a second embodiment pillbox loading device 110 that is similar to the loading device 10. In this embodiment the inclined floor portions 44*a* are less steep as compared to the device 10 so that the top opening 40 is spaced vertically above the horizontal slot wall 36. The pillbox P can slide through the slot 30 without obstruction from the top 26 to place the pillbox containers within the box interior 20. The slots 38 of the device 10 are eliminated because the channels 42 do not extend into the pillbox containers during use. To assist in positioning the device 110 relative to the pillbox, interior side walls 47 and 47' are sized to closely receive the body of the pillbox as the pillbox slides into the box member 11.

The slope of the inclined floor portions 44*a* in other embodiments of the device 110 can be increased by increasing the height of the box 11.

Figure 6:
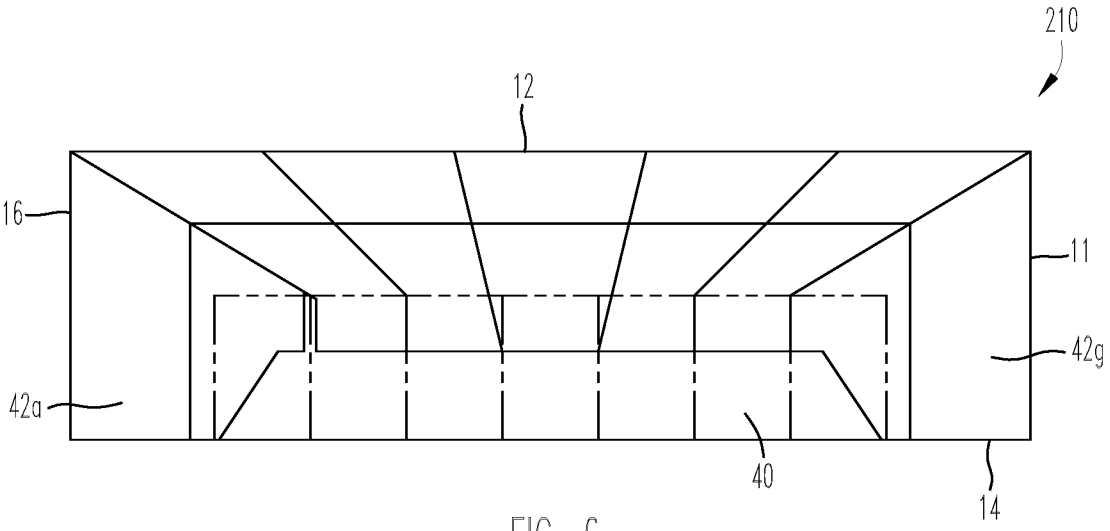
FIG. 6 is a top view of a third embodiment pillbox loading device.

FIG. 6 illustrates a third embodiment pillbox loading device 210 that is similar to the loading device 110. The loading device 210 differs from the loading device 10 in that the top 26 adjacent the respective end walls 16, 18 extends entirely to the second side wall 14. The side wall 14 bounds one side of the channel 42*a* and the channel 42*g* and allows the width of the channel ledges of the channels 42*a*, 42*g* to be increased.

Figure 7:
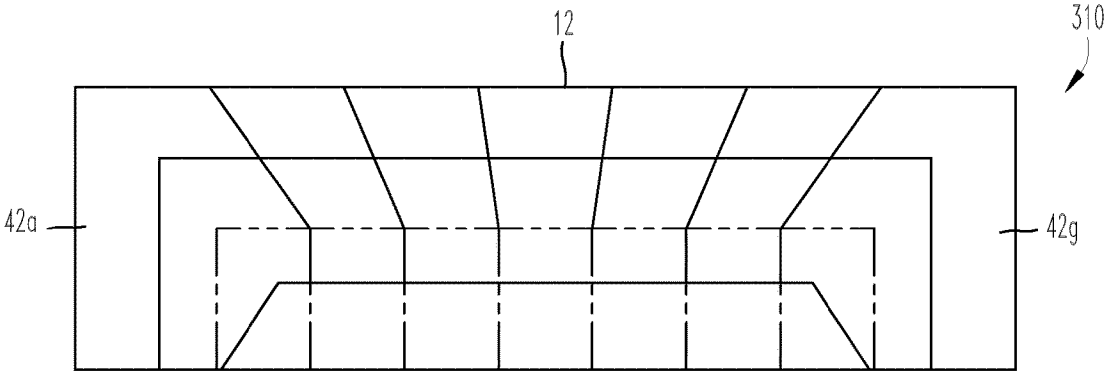
FIG. 7 is a top view of a fourth embodiment pillbox loading device.

FIG. 7 illustrates a fourth embodiment pillbox loading device 310 that is similar to the loading device 210. The loading device 310 differs from the loading device 210 only in the width of the channels 42. The channels 42*a*, 42*g* in addition to extending towards respective end walls 16, 18 also extend towards the side wall 12. The width of the channel ledges of the other channels 42*b*-42*f* is reduced from those of the device 210.

Figure 8:
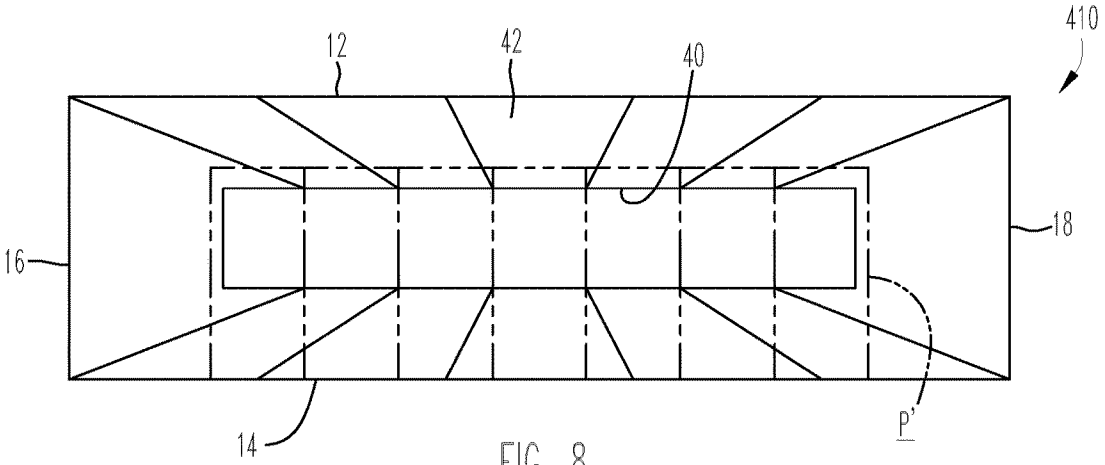
FIG. 8 is a top view of a fifth embodiment pillbox loading device.

FIG. 8 illustrates a fifth embodiment pillbox loading device 410 that is intended for loading a pillbox P'. In this embodiment the top opening 40 is centered between the side walls 12, 14 and the end walls 16, 18. The channels 42 each extend away from both sides of the opening 40 to the adjacent side and end walls. This embodiment enables channel ledges to be formed along both side walls 12, 14.

Figure 10:
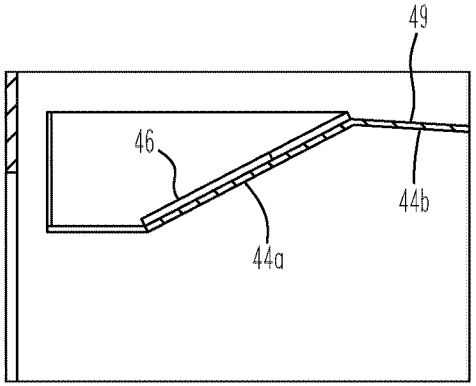
FIG. 10 is a sectional view of the pillbox loading device shown in FIG. 9 taken along lines 10-10 of FIG. 9.
Figure 9:
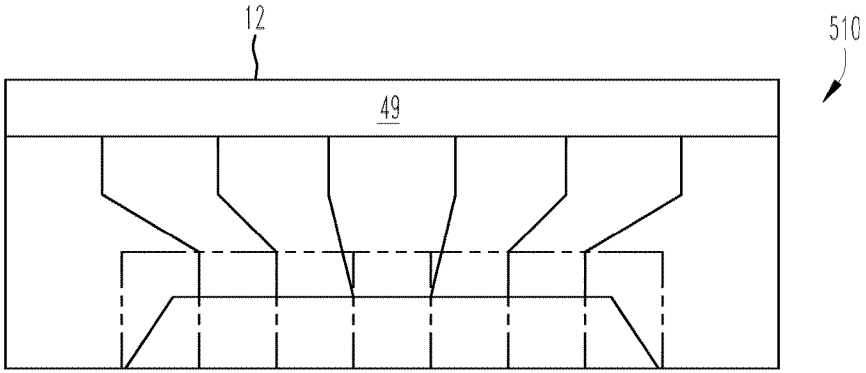
FIG. 9 is a top view of a sixth embodiment pillbox loading device.

FIGS. 9 and 10 illustrate a sixth embodiment pillbox loading device 510. The pillbox loading device 510 is similar to the device 310 but the channel walls 46 are located on only the upwardly sloping channel portions 44*a* and stop at the ledge channel portions 44*b*. The ledge portions 44*b* form a single obstruction-free ledge 49 that extends the width of the first side wall 12. The ledge channel portions 44*b* also slope downwardly from the ledge channel portions 44*a* to the adjacent side or end walls. When the device 510 is placed on a horizontal surface, pills placed on the ledge 49 are urged by gravity towards the side wall 12. After all the pills intended to be loaded are placed on the ledge 49, a user slides the pills off the ledge and into the channels to load the pillbox.

Figure 11:
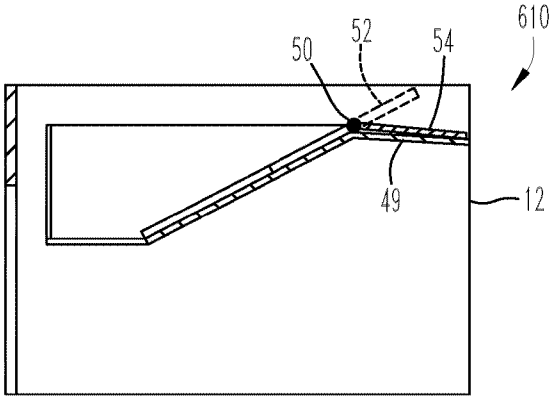
FIG. 11 is a sectional view similar to FIG. 10 of a seventh embodiment pillbox loading device.

FIG. 11 illustrates a seventh embodiment pillbox loading device 610. The pillbox loading device 610 is similar to the device 510 but includes an elongate rotatable shaft 50 journaled in the end walls 16, 18. The shaft 50 is located just above the side of the ledge 49 closely spaced from the upper ends of the channels 46. The shaft 50 is rotated by a handle 52 located outside of the box member 11. Attached to the shaft 50 for rotation with the shaft 50 is a flat plate 54 that normally sits just above and essentially covers all the ledge 49. As shown in FIG. 11, the plate 54 in its normal position slopes downwardly with the ledge 49 towards the side wall 12 and rests against the ledge 49. Pills are loaded on top of the plate 54, and the shaft 50 is rotated counterclockwise by the user as viewed in FIG. 11. This rotates the plate 54 away from the ledge 44 and tilts the plate 55 upwardly so that gravity urges the pills to move off the plate 55 and onto the channels 42.

Figure 13:
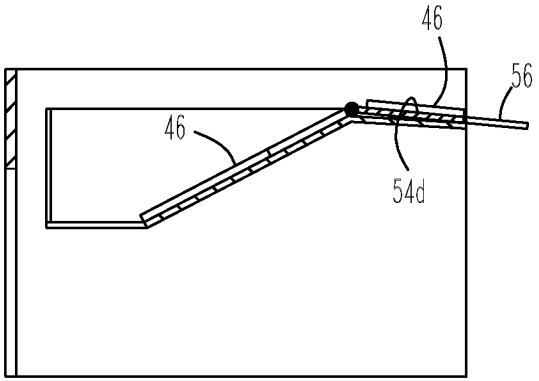
FIG. 13 is a sectional view of the pillbox loading device shown in FIG. 12 taken along line 13-13 of FIG. 12.
Figure 12:
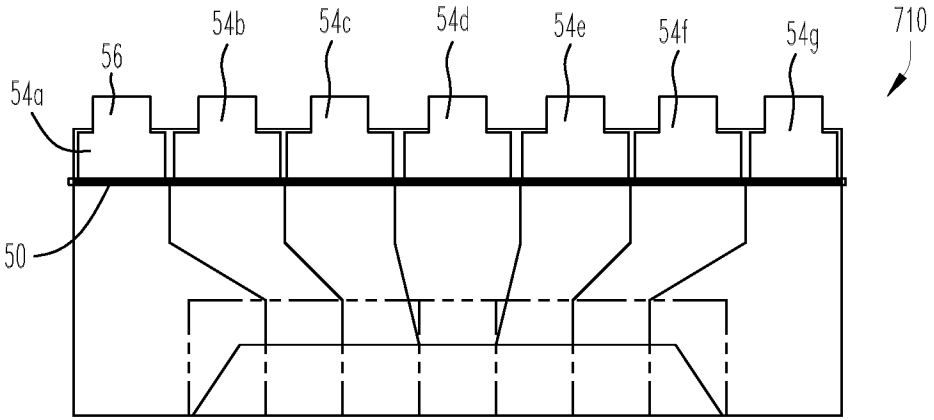
FIG. 12 is a top view of an eighth embodiment pillbox loading device.

FIGS. 12 and 13 illustrate an eighth embodiment pillbox loading device 710. The pillbox loading device 710 is similar to the device 610 but the plate 54 is replaced with individual plates 54*a*-54*g*. Each plate 54*a*-54*g* is rotatable about a fixed shaft 50 and includes a tab 56 that extends through a slot in the side wall 12. The channel walls 46 include wall segments located on opposite sides of a plate 54. A user loads the plates with pills, and then uses the tabs 56 to individually rotate a plate for loading an individual pill compartments. In other possible embodiments the plates 54*a*-54*g* are designed to either individually rotate or to rotate together as a unit at the user's option. Each plate 54 would be designed in an embodiment to selectively snap or otherwise connect to adjacent plates for conjoint rotation with the adjacent plates. In yet other embodiments an additional actuator such as a rod that goes beneath the tabs 56 and revolves around on an axis similar to the shaft axis 50 could drive the plates simultaneously for loading the pill compartments.

Although the illustrated embodiments have been described being used to load pills into the pillbox compartments, it should be understood that this is exemplary only and that the described loading device can be used to load other small items—buttons, jewelry, coins, or the like—into a pillbox.

While one or more embodiments have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

What is claimed is:

1. A pillbox loading device comprising:

a box-like member comprising spaced apart first and second side walls, spaced apart first and second end walls interconnecting the first and second side walls, the first and second end walls spaced apart from one another in a horizontal direction, and a top closing an upper end of the box-like member, each of the end walls and side walls extending in a vertical direction downwardly away from the top;

the first side wall comprising a slot extending through the first side wall, the slot being spaced vertically from an upper end of the first side wall, the slot having a horizontal width defined by a pair of spaced apart slot edges being disposed at opposite ends of the slot; and the top comprising a plurality of channels and channel walls separating adjacent pairs of channels, the top further comprising an opening through the top;

the top opening having a horizontal width extending in the horizontal direction, the top opening being horizontally spaced away from one or both of the end walls, the top opening being spaced vertically between the upper end of the box-like member, and the slot of the first side wall, and the top opening being horizontally aligned with the slot of the first side wall;

the plurality of channels being side-by-side to one another and extending from the first end wall to the second end wall, each channel comprising a floor extending away from the top opening and sloping upwardly from the top opening towards the top and channel walls dividing the end of the box-like member, the channel walls being proud of the channel floors.

2. The pillbox loading device of claim 1 wherein the floor of each channel of the plurality of channels has a width dimension that increases as the floor extends away from the opening.

3. The pillbox loading device of claim 1 wherein the plurality of channels comprises a first channel adjacent to the first end wall, the floor of the first channel extending away from the top opening and sloping upwardly from the top opening towards the first end wall.

4. The pillbox loading device of claim 1 wherein the plurality of channels comprises a second channel adjacent to the second end wall, the floor of the second channel extending away from the top opening and sloping upwardly from the top opening towards the second end wall.

5. The pillbox loading device of claim 1 wherein the plurality of channels comprises a first channel adjacent to the first end wall, a second channel adjacent to the second end walls, and one or more additional channels disposed between the first and second channel, the floor of each of the one or more additional channels extending away from the opening and towards the second side wall.

6. The pillbox loading device of claim 1 wherein the top opening is immediately adjacent to the first side wall.

7. The pillbox loading device of claim 1 wherein the top opening is spaced from both the first and second end walls.

8. The pillbox loading device of claim 1 wherein the slot of the first side wall is horizontally centered between the first and second end walls.

9. The pillbox loading device of claim 1 wherein the slot of the first slide wall is open at a lower end of the first side wall.

10. The pillbox loading device of claim 1 wherein the top has seven channels.

11. The pillbox loading device of claim 1 wherein the floor of each channel comprises a first floor portion that slopes upwardly from the top opening towards the upper end of the box-like member and a second floor portion inclined with respect to the first floor portion, the first floor portion extending from the top opening to the second floor portion, the second floor portion extending from the first floor portion to at least one of the side walls or end walls.

12. The pillbox loading device of claim 11 wherein each second floor portion is perpendicular to the second side wall.

13. The pillbox loading device of claim 12 wherein the second floor portion of each channel slopes toward the lower end of the box-like member as the second floor portion extends away from the first floor portion of the channel.

14. The pillbox loading device of claim 1 wherein the channel walls are located on only the first floor portions of the channels.

15. The pillbox loading device of claim 1 wherein each of the side walls and end walls of the box-like member extend to respective ends, the ends of the side walls and end walls being co-planar.

16. The pillbox loading device of claim 12 comprising a plate spaced above the second floor portions and rotatable away from the second floor portions.

17. The pillbox loading device of claim 12 comprising a respective plate spaced above each second floor portion, the plate rotatable away from the said each second floor portion.

18. The pillbox loading device of claim 1 in combination with a pillbox, the pillbox comprising a body defining a plurality of compartments, each compartment having an open top, the pillbox body receivable in the slot of the first side wall with the compartment openings at least partially disposed within the box-like member and the top opening over the compartment openings, each channel comprising an end at the opening and vertically aligned with the compartment.

19. The combination pillbox loading device and pillbox of claim 18 wherein the compartments of the pillbox are arranged side-by-side and define a row of compartments.

20. The combination pillbox loading device and pillbox of claim 18 wherein each floor surface extends into a respective compartment of the pillbox.

* * * * *